US006491539B1

(12) United States Patent
Johnston

(10) Patent No.: US 6,491,539 B1
(45) Date of Patent: Dec. 10, 2002

(54) ELECTRICAL PLUG RETAINER

(76) Inventor: Jeff Johnston, 722 W. Chadwick Cir., Highlands Ranch, CO (US) 80126

( * ) Notice: Subject to any disclaimer, the term of this patent is extended or adjusted under 35 U.S.C. 154(b) by 0 days.

(21) Appl. No.: 09/682,132

(22) Filed: Jul. 25, 2001

(51) Int. Cl.[7] ..... H01R 13/62
(52) U.S. Cl. ..... 439/373; 439/371; 439/369
(58) Field of Search ..... 439/373, 371, 439/369; 174/67

(56) References Cited

U.S. PATENT DOCUMENTS

| | | | | |
|---|---|---|---|---|
| 2,089,665 | A | | 8/1937 | Roberts et al. |
| 2,240,050 | A | | 4/1941 | Nuebling |
| 2,415,602 | A | | 2/1947 | Monaco |
| 2,526,606 | A | | 10/1950 | Gregg |
| 2,675,530 | A | * | 4/1954 | Sadasky ..... 439/373 |
| 2,913,791 | A | | 11/1959 | Martin |
| 2,942,226 | A | | 6/1960 | Low |
| 3,775,729 | A | | 11/1973 | Casper |
| 3,838,383 | A | | 9/1974 | Wilbur et al. |
| 3,960,432 | A | | 6/1976 | Wilbur |
| 4,045,108 | A | | 8/1977 | Olsen |
| 4,083,618 | A | | 4/1978 | Busch |
| 4,105,274 | A | | 8/1978 | Casey |
| 4,424,407 | A | * | 1/1984 | Barbic ..... 174/67 |
| 4,457,571 | A | | 7/1984 | Lavine |
| 4,618,200 | A | | 10/1986 | Roberts et al. |
| 4,702,709 | A | | 10/1987 | Santilli |
| 4,789,353 | A | | 12/1988 | Busta et al. |
| 5,011,427 | A | | 4/1991 | Martin |
| 5,044,976 | A | | 9/1991 | Thompson |
| 5,049,086 | A | | 9/1991 | Slaven |
| 5,179,044 | A | | 1/1993 | Muromachi et al. |
| 5,299,099 | A | * | 3/1994 | Archambault ..... 361/837 |
| 5,348,495 | A | | 9/1994 | Kasden |
| 5,547,390 | A | | 8/1996 | Laherty |
| 5,575,677 | A | | 11/1996 | Buckner et al. |
| D409,986 | S | | 5/1999 | Libecap |
| 5,928,023 | A | | 7/1999 | Buckner et al. |
| 5,934,919 | A | | 8/1999 | Cross et al. |
| 5,989,052 | A | | 11/1999 | Fields et al. |
| 6,033,251 | A | * | 3/2000 | Cook ..... 439/369 |
| 6,071,142 | A | | 6/2000 | Blackman |
| 6,095,846 | A | | 8/2000 | Becerra |
| 6,196,859 | B1 | | 3/2001 | Garlarza |

* cited by examiner

*Primary Examiner*—P. Austin Bradley
*Assistant Examiner*—Alexander Gilman
(74) *Attorney, Agent, or Firm*—Roger A. Jackson

(57) ABSTRACT

An electrical plug retainer assembly 20 and method of use for the purpose of securing an electrical plug 40 and cord 38 set assembly to a wall mounted electrical plug receptacle 22 to prevent inadvertent or accidental removal of the plug 40 from the receptacle 22. The electrical plug retainer assembly 20 includes a support arm 46 attached to the receptacle assembly body 25 with a retention element 54 securing the plug 40 and cord 38 to the support arm 46 to resist pulling forces 70 exerted against the plug 40 and cord 38. Thus, preventing the pulling forces 70 from causing the undesirable result of disconnecting the plug 40 from the receptacle 22 with the resulting loss of electrical power.

29 Claims, 4 Drawing Sheets

ELECTRICAL PLUG RETAINER

TECHNICAL FIELD

The present invention generally relates to securing electrical cord plugs to wall mounted electrical plug receptacles, and more particularly to the use of a support arm attached to the receptacle with a retention element securing the plug to the support arm to resist pulling forces exerted against the plug or cord that would cause the undesirable result of disconnecting the plug from the receptacle.

BACKGROUND OF INVENTION

Electrical plug receptacles are well known to provide access to the main power supply of a building or residence. These receptacles are often mounted in an opening formed in the building wall. Once the electrical receptacle has been mounted in wall, a cover plate is typically secured over the opening so that the only access openings are the exposed receptacles that are approximately flush with the wall surface. Typically, the electrical plug receptacle, commonly called a duplex receptacle outlet has a threaded mounting hole that is approximately located in the center of the receptacle that is between the two electrical plug receptacles, with a screw that mounts in the threaded hole wherein the screw secures the cover plate to the receptacle.

While the previously known electrical plug receptacles permit electrically operated devices to receive the electrical power by merely plugging in an appropriate plug into the receptacle, however, the plug can be easily removed from the receptacle as well. Thus, when the electrical cord extending between the plug and the electrically operated device is pulled upon, either from moving the device, a person tripping over the cord, the inadvertent activities of a child or a pet can cause the cord and hence the plug to be pulled upon. This pulling tension in the cord can easily displace the plug from its receptacle connection resulting in an the undesirable loss of electrical power to the device.

The desire of securing the plug to the receptacle is a well-known problem in the prior art and there have been a number of previously known inventions for maintaining the plug in its inserted position within the receptacle thus protecting against inadvertent removal of the plug from the receptacle. These previously known inventions that attempt to solve the problem of retaining the plug in the receptacle have for the most part, required extensive modifications or specialized construction of the receptacle, cover plate, the plug and cord, or even the receptacle housing that is mounted in a wall. Hence, these modifications or specialized construction tended to not be economically practical due to the additional cost and complexity required to solve the aforementioned problem. Prior art examples would be U.S. Pat. No. 4,702,709 to Santilli that uses a pivotally mounted bracket attached to a special frame piece that mounts against receptacle, or U.S. Pat. No. 5,934,919 to Cross et al. requires a special cover plate that has interlocking channels that attach to a plug retainer. Other examples would be a U.S. Pat. No. 5,299,099 to Archambault that also requires a special cover plate that has raised bars to loop retainer straps through and across the plug for retention, and U.S. Pat. No. 5,989,052 to Fields et al. utilizes another version of a special cover plate that has special interlocking slots that engage a cap that fits over the plug wherein the cap interlocks in to the special cover plate slots.

Another issue with the aforementioned prior art has to do if whether the plug is secured or the cord is secured. A safety issue can exist if only the plug is secured in this situation where a substantial pulling force is experienced by the cord alone with the plug retained against the receptacle results in there being a risk that the cord will disengage from the plug. This disengagement can be quite risky because of the haphazard breaking that may occur of the insulation and wires inside of the insulation in the cord, given the fact that the cord is electrically live which can potentially result in electrocution of an individual, fire or damage to the electrical device itself, not to mention the destruction of the cord and plug assembly. This problem has been identified in the prior art, however, a number of the prior art inventions in this area do in fact only retain the plug, such as Cross et al., Archambault, and Fields et al. Other prior art such as U.S. Pat. No. 5,547,390 to Laherty, U.S. Pat. No. 3,838,383 to Wilbur et al., and U.S. Pat. No. 2,089,665 to Roberts et al. do indeed secure only the cord at a distance from the plug which would generally be desirable given the above information. However, another issue does exist especially related to the inadvertent or accidental removal of the plug from the receptacle by a child or pet, in that the distance of the cord from the plug and cord termination point on the plug to the cord retention point. Given the flexibility of the cord, the plug can still be removed from the receptacle even with the cord retention device securely in place, thus allowing a serious flaw in the ability of the plug and receptacle retention device to effectively prevent inadvertent or accidental removal of the plug from the receptacle causing an undesirable loss of electrical power. In other words, there is no true "locking" of the plug to the receptacle given that the plug can still be inadvertently removed from the receptacle thus overriding the retention device.

Still another issue, is the electrical conductivity of the plug and receptacle retention device itself, to maximize safety the retention device should be non conductive. Thus, the retention device should be constructed of non electrical conducting materials to further protect against an inadvertent electrical short circuit in either the plug or the cord being transmitted into the retention device and adding to the risk of electrocution of an individual or fire. In addition, constructing the retention device from resilient materials such as plastic, helps to avoid cutting or nicking damage to the plug and cord further reducing the risk of electrocution or fire. U.S. Pat. No. 2,089,665 to Roberts et al., U.S. Pat. No. 3,960,432 to Wilbur, and U.S. Pat. No. 3,838,383 to Wilbur et al., are all examples of plug and receptacle retention devices that can potentially be electrically conductive by being constructed of metallic materials that also have the undesirable feature of a sharp hard edges that can potentially nick and cut the plug and cord where the retention device comes into contact with the plug and cord.

A final issue with the plug and receptacle retention devices is the ability to retain one plug in a duplex receptacle and not retain another plug in a duplex receptacle, in other words to not have the retention device require all plugs in the receptacle to be retained. A number of the prior art devices force the user to retain the plug in both receptacles of the duplex receptacle. Examples would be U.S. Pat. No. 3,775,729 to Casper and U.S. Pat. No. 6,095,846 to Becerra that do not allow one receptacle out of a duplex receptacle assembly to be freely used by multiple electrical devices necessitating a number of different plugs to be easily used in and out of one of the receptacles while the other receptacle of the duplex receptacle assembly has the plug secured or retained to the other receptacle outlet.

What is needed is an electrical plug retention device that can accommodate the widely varying size differences of plugs and cords, has the ability to retain the cord alone to protect the cord plug interface from separating due to cord pulling tension, is made of non conducting and non cutting or nicking materials, and has the ability to leave one receptacle free and retain a plug in the other receptacle of the duplex receptacle assembly. Also, the retention device should be easy to install, inexpensive, and require no modification to the existing duplex receptacle assembly. In addition, the retention device should be child and pet proof, in other words "lockable" to prevent the inadvertent or accidental removal of the plug from the receptacle.

SUMMARY OF INVENTION

It is an object of the present invention to secure or retain an electrical plug to a receptacle for the purpose of preventing an undesirable loss of electrical power to an electrical device.

It is another object of the present invention to provide an electrical plug retainer that can accommodate a wide variety of size differences of plugs and cords.

It is still another object of the present invention to have the capability of retaining the cord alone to protect the cord plug interface from cord pulling damage.

It is yet another object to the present invention to lockably retain the plug in the receptacle to prevent children and pets from inadvertently or accidentally removing the plug from the receptacle.

It is a further object of the present invention for the retainer to be constructed of non conductive material that has no hard or sharp edges to minimize the safety risk from an electrical short circuit or physical damage to the plug or cord.

It is yet further an object of the present invention to allow at least one receptacle to be freely used while another receptacle in the same outlet assembly has the electrical plug retainer in use.

It is still yet another object of the present invention to not require modifications to the existing duplex receptacle assembly and allow for easy installation with minimal or no tools required.

The present invention is an improved electrical plug retainer system that is adapted to lockably secure a plug and cord set assembly that is removably engaged to an electrical receptacle. The electrical plug retainer system protects against accidental removal of the plug and cord set assembly from the receptacle. The electrical plug retainer system includes a support arm that extends from and is supported by the electrical receptacle. The support arm includes a proximal end portion that is adjacent to the receptacle and a distal end portion that is opposite of the proximal end portion of the support arm. The electrical plug retainer system also includes a retention element that is adapted to engage the distal end portion of the support arm, the retention element secures the plug and cord set assembly to the support arm when the retention element is in a locked state. The retention element is removable from the distal end portion of the support arm when it is in an unlocked state. The plug and cord set assembly is lockably secured to the electrical receptacle when the retention element is in a locked state.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
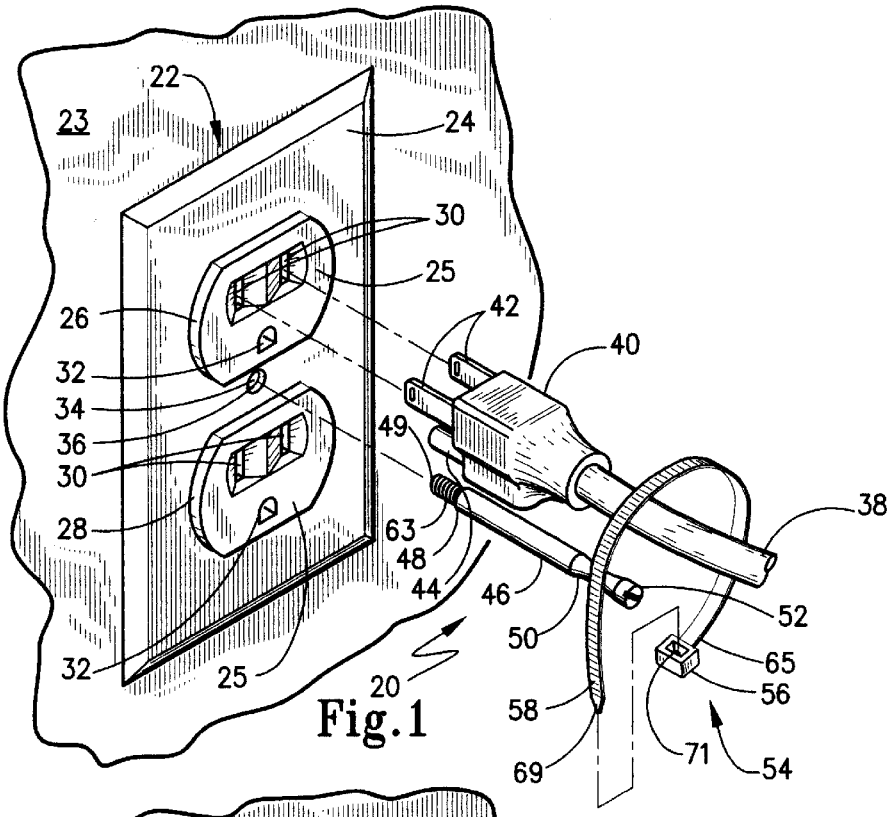
FIG. 1 shows an exploded perspective view of the electrical plug retainer assembly in use with a standard duplex electrical outlet.

20 Electrical plug retainer assembly with long support arm

21 Electrical plug retainer assembly with short support arm and cord wrap retention element

22 Electrical wall outlet assembly

23 Wall mounting

24 Receptacle cover plate for wall

25 Receptacle assembly

26 Upper Receptacle2

27 Electrical plug retainer assembly with short support arm

28 Lower Receptacle

29 Electrical plug retainer assembly

30 Receptacle plug channels short slotted

31 Electrical plug retainer assembly with long support arm for two plugs

32 Ground receptacle channel

33 Electrical plug retainer assembly with short support arm for two plugs

34 Receptacle cover plate countersink

36 Threaded opening in receptacle assembly

38 Electrical cord

40 Plug body

42 Extension prongs in plug body

44 Ground extension prong in plug body

46 Support arm long

48 Support arm proximal end portion

49 Support arm threaded portion

50 Support arm distal end portion

51 Support arm neck portion

52 Support arm distal end
54 Retention element assembly for long support arm
55 Retention element assembly for short support arm
56 Retention element head
57 Retention element assembly for cord wrap
58 Retention element ridged strap
59 Retention element assembly for short slotted support arm
60 Long support arm slotted6
62 Support arm slotted proximal end portion
63 Support arm countersink mating surface
64 Support arm slotted threaded portion
65 First end of ridged strap
66 Slot for slotted support arm6
67 Support arm slotted distal end portion
68 Support arm slotted distal end
69 Second end portion of ridged strap
70 Pull direction of cord
71 Transverse opening of retention element head
72 Support arm short
73 Support arm middle portion
74 Support arm short slotted
75 Middle portion of slotted support arm
76 Kit package
77 Countersink mating surface of slotted support arm
78 Kit information card
79 Plug and cord interface
80 Kit assembly

DETAILED DESCRIPTION

The present invention is an improved electrical plug retainer system that is adapted to lockably secure a plug and cord set assembly that is removably engaged to an electrical receptacle. The electrical plug retainer system protects against accidental removal of the plug and cord set assembly from the receptacle. The electrical plug retainer system includes a support arm that extends from and is supported by the electrical receptacle. The support arm includes a proximal end portion that is adjacent to the receptacle and a distal end portion that is opposite of the proximal end portion of the support arm. The electrical plug retainer system also includes a retention element that is adapted to engage the distal end portion of the support arm, the retention element secures the plug and cord set assembly to the support arm when the retention element is in a locked state. The retention element is removable from the distal end portion of the support arm when it is in an unlocked state. The plug and cord set assembly is lockably secured to the electrical receptacle when the retention element is in a locked state.

With initial reference to FIG. 1 shown is an exploded perspective view of the electrical plug retainer assembly being assembled prior to use with a standard duplex electrical outlet. Starting with the electrical plug retainer assembly 20 which is shown with the long support arm 46 it can be seen that the long support arm 46 includes a proximal end portion 48 and on the opposite end of the support arm 46 a distal end portion 50 is shown. In addition, the distal end portion 50 of the long support of 46 terminates in a distal end 52 as shown. A conventional electrical plug 40 is shown with a cord section 38, on the side of the plug 40 opposite of the cord 38 are the extension prongs 42 that extend from the plug 40 and a ground extension prong 44 that also extends from the plug 40. Both of the extension prongs 42 and ground extension prong 44 are removably engaged to the electrical receptacle 25, such that the extension prongs 42 and the ground extension prong 44 insert into the respective receptacle plug channels. The extension prongs 42 insert into mating receptacle plug channels 30 that are located in the receptacle 25, also the ground extension prong 44 inserts into the meeting ground receptacle channel 32. As is well-known in the prior art to when the plug 40 is engaged to the electrical receptacle 25 the transmission of electrical power can occur from the receptacle 25 acting through the extension prongs 42 and transmitting electrically to the cord 38, with the ground connection to the ground prong 44 into the ground receptacle channel 32 increasing the safety of the circuit by helping to prevent electric shock.

An industry standard receptacle 25 and is shown that includes an upper receptacle 26 and a lower receptacle 28, this is termed in the industry as a duplex outlet or receptacle, with both the upper receptacle 26 and the lower receptacle 28 connected in parallel electrically providing an equal amount of available power for a mating plug 40. The electrical receptacle 25 typically mounds in a wall mounting structure 23 and utilizes a receptacle cover plate 24 to cover the exposed wiring that exists behind and to the side of the receptacle 25. There is normally provided a threaded opening 36 in the receptacle 25 that is adapted to receive a fastener that secures the cover plate 24 to the receptacle 25. In order to have a smooth appearing finish on the cover plate 24, there is typically a countersink in the cover plate the allows the fastener to have a flush or nearly flush installed appearance with the cover plate 24. The aforementioned components form the electrical wall outlet assembly 22 which includes the receptacle 25, the cover plate 24 and the fastener (not shown).

As can be seen from FIG. 1 the long support arm 46 acting through the proximal end portion 48 would replace the standard fastener that retains the cover plate 24 to the receptacle 25. The proximal end portion 48 configuration duplicates the configuration of the cover plate fastener insofar as the threads 49 and countersink portion mating surface 63 to enable the long support arm 46 to essentially replace the fastener in securing the cover plate 24 to the receptacle 25. This results in one of the major benefits of this support arm 46 configuration in that no modifications are required to either the cover plate 24 or the receptacle 25, which greatly simplifies installation of the long support arm 46 into an existing electrical wall outlet assembly 22. Also, this proximal end portion 48 configuration for installation into an existing electrical wall outlet assembly 22 which includes the threads 49 and a countersink portion 63 is also applicable to varying lengths of support arms including the shorter support arm 72 as detailed in FIG. 2, and both of the slotted support arm versions as detailed in FIG. 3 being the long slotted support arm 60 and the short slotted support arm 74. Distal end 52 is shown in FIG. 1 with a standard straight blade screwdriver slot whose purpose is to enable the rotational tightening of the support arm 46 for the threadable engagement of the long support arm 46 into the receptacle 25 with the cover plate 24 being held in place by the interference between the cover plate countersink 34 and the support arm countersink mating surface 63. Although, a standard straight blade screw driver slot is shown on the distal end 52, any means of creating a rotational driving ability to tighten the threaded engagement between the long support arm 46 and the receptacle 25 would be acceptable. Examples for the distal end 52 rotational driving means would be a Phillips type head, a surface grip for finger tightening, a hex head, a TORX (r) brand tool type drive, or any other equivalent structure to accomplish rotational tightening of the threadable engagement between the long support arm 46 and the receptacle 25. Also, the use of a tamper proof rotational driving means could be utilized to provide further locking of the long support arm 46 to the electrical receptacle 25, by not allowing direct disengagement of the threadable engagement. Note that, when the electrical plug retainer system is assembled or installed that the circumferential engagement of the retention element assembly 54 to the distal end portion 50 will prevent the threadable engagement of the long extension arm 46 from loosening and thereby preventing the separation of the long support arm 46 from the receptacle 25.

Although FIG. 1 shows the long support arm 46 being attached to the receptacle 25 utilizing the threaded portion 49 engaging with the threaded opening 36 in the receptacle 25 that normally retains the cover plate 24, this results in the long support arm 46 extending from and being supported by the receptacle 25 in an approximately perpendicular manner. Alternative mounting methods and structures can be used to accomplish the requirement that the long support arm 47 extends from and is supported by the receptacle 25. This would include attaching the long support arm 46 to the receptacle 25 at another location being adjacent to the receptacle 25 other than the threaded opening 36 for the cover plate 24. Additionally, the long support arm 46 attachment to the receptacle 25 could be detachable or permanent and such as a snap arrangement, an interlocking bracket, adhesives, or any other method or structure that allows the long support arm 46 to extend from and be supported by the receptacle 25. However, any attachment used between the support arm 46 and the electrical receptacle 25 needs to meet the requirement that when the retention element assembly 54 is in a locked state lockably engaging the distal end portion 50 of the support arm 46 with the plug 40 and cord 38 assembly, that the support arm 46 not be directly disengaged or removable from the electrical receptacle 25 that would allow the plug 40 and cord 38 assembly to not be lockably secured to the electrical receptacle 25.

The materials of construction for the long support arm 46 are preferably of the non electrically conductive type and will not have any sharp edges to risk cutting or nicking the plug 40 or cord 38 that can add to the risk of electrical shock by potentially exposing an electrically live wire. Non conductive materials are preferred not only to help to minimize the risk of electrical shock but to minimize the effect of chaffing wear or rubbing abrasion that could potentially occur between the plug 40 and cord 38 with the long support arm 46, due to the wire coming in contact with the long support arm 46. Long support arm 46 could be constructed of an injected plastic type material that would have sufficient strength to retain the plug 40 and cord 38 to the receptacle assembly 22 while also meeting the above requirements. Alternative materials for the long support arm 46 would be acceptable as long as the aforementioned requirements are met. Although the long support arm 46 is shown in FIG. 1 as having a cylindrical shape, and other shapes would be acceptable such as square, rectangular, elliptical, or any other configuration wherein the functional requirements of the long support arm 46 would be met, including the ability to be a support arm 46 extending from and supported by the receptacle 25. Also, alternative configurations of the long support arm 46 would need to meet the requirements previously mentioned for the proximal end portion 48, the distal end portion 50, and the distal end 52.

The retention element assembly 54 includes a retention element head 56 and a retention element ridged strap 58. The ridged strap 58 has a first end 65 where the head 56 is attached, the ridged strap 58 also has a second end portion 69 that is designed to be lockably received into a transverse aperture 71 of the head 56. The strap 58 is a flexible member as shown in FIG. 1, having the ability to engage both the plug 40 and cord 38 with the distal end portion 50 of the long support arm 46. The retention element assembly 54 as shown is in a non lockably engaged or unlocked state with the phantom line showing where the second end portion 69 is lockably received into aperture 71. This locking feature can be permanent with the retention element assembly 54, in that the only means for disassembly or putting the retention element assembly 54 into an unlocked state from a locked state would require the cutting or severing of the strap 58. However, the locking feature of the retention element assembly 54 could be reversible with a feature to allow the strap 58 to be removed from the aperture 71, thus placing the retention element assembly 54 in an unlocked state without the destruction of the strap 58. This reversible feature of the aperture 71 would require a means for preventing unauthorized individuals such as small children from figuring out how to place the retention element assembly 54 from a locked state to an unlocked state. The retention element assembly 54 can be purchased item which is typically called in the trade a "cable tie" or a "ty rap", and is available from Thomas and Betts catalog #10440 C, that is 4 in. long and has a tensile strength of 18 lbs. Alternative configurations and materials could be used for the retention element assembly 54, that meet the requirements of being electrically non conductive, not having any sharp edges, and being able to lockably engage the plug 40 and cord 38 to the distal portion 50 of the support arm 46.

Figure 2:
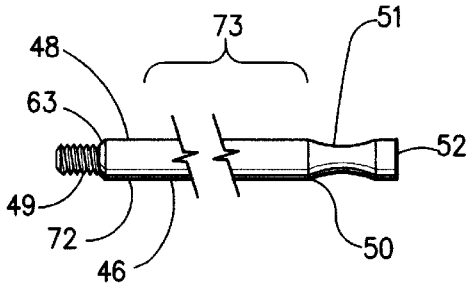
FIG. 2 shows a side view detail of the support arm with a threaded portion and a neck portion having a variable length intermediate section.

Next, turning to FIG. 2 the long support arm 46 is shown separately with the proximal end portion 48 that includes the threaded portion 49 and the countersink mating surface 63. On the opposite end of the long support arm 46, the distal end portion 50 is shown that includes the distal end 52 and the neck portion 51. Also shown, is the short support arm 72 that has the same proximal end portion 48 components as the long support arm 46. These are the threaded portion 49 and the countersink mating surface 63 that combine to make a portion of the proximal end of either the long support arm 46 or short support arm 72. Similarly the distal end portion 50 the includes the distal end 52 and neck portion 51 is the same for either the long support arm 46 for the shorter support arm 72. One difference between the long support arm 46 and the short support arm 72 exists in the length of the middle portion 73 of the support arm which has a varying length to accommodate either variance in the plug 40 and cord 38 configuration or there is a restriction in the space available for mounting the long support arm 46 or short support arm 72.

Figure 3:
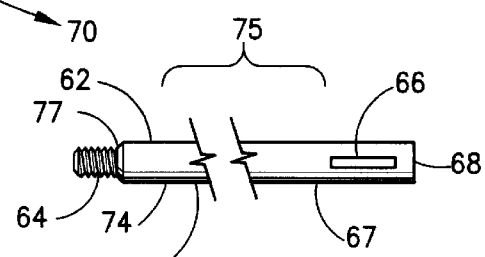
FIG. 3 shows a side view detail of the slotted support arm with a threaded portion and a slotted portion having a variable length intermediate section.

Further, to FIG. 3 a side view is shown of the slotted support arm with a threaded portion and a slotted portion having a variable length intermediate section. Similar to the long support arm 46 and the short support arm 72 as described in FIG. 2, there is an intermediate section or middle portion 75 that can vary in length as required to accommodate either variance in the plug 40 and cord 38 configuration or if there is a restriction in the space available for mounting the long slotted support arm 60 or the short slotted support arm 74. The proximal end portion 62 of the slotted support arm includes a countersink mating surface 77 and a threaded portion 64. On the opposite end of the slotted support arm is the distal end portion 67 that includes the slot 66 and the distal end 68. The threaded portion 64 and the countersink meeting surface 77 engage and mate with the receptacle 25 as described in FIG. 1. The slot 66 is adapted to receive the strap 58 of the retention element assembly 54. This particular option allows for a positive engagement between the retention element assembly 54 and either the long slotted support arm 60 or the short a slotted support arm 74.

Figure 4:
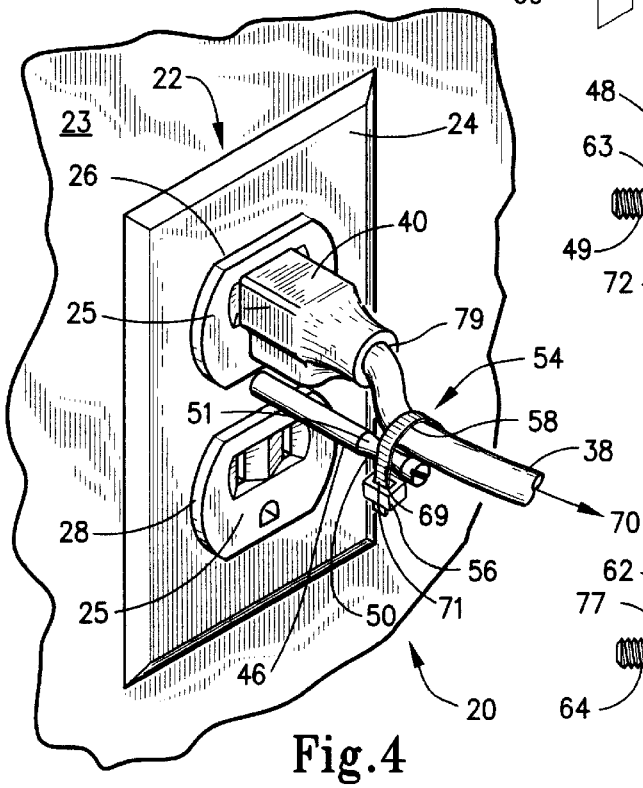
FIG. 4 shows an assembled perspective view of the electrical plug retainer assembly in use with a standard duplex electrical outlet utilizing the long support arm.

Following on to FIG. 4, an assembled perspective view is shown of the electrical plug retainer assembly in use with a standard duplex electrical outlet utilizing the long support arm 46. The plug 40 is shown engaged to the upper electrical receptacle 26, wherein electrical power can now be transmitted from the receptacle assembly 25 into the cord 38. The long support arm 46 is threadably engaged into the receptacle 25 and shown retaining the cover plate 24 place. Retention element assembly 54 is shown and a locked state with the strap 58 showing the head 56 having the transverse aperture 71 lockably receiving a second end portion 69 of the strap 58. Thus, the retention element assembly 54 is engaging the distal end portion 50 of the long support arm 46 and is securing the plug 40 and cord 38 set assembly to the long support arm 46, with the retention element assembly 54 being in a locked state resulting in the plug 40 and cord 38 assembly and being lockably secured to the upper receptacle 25. The distal end portion 50 of the long support arm 46 shows the neck portion 51 engaging the strap and 58 of the retention element assembly 54, neck portion 51 helps to retain the retention element assembly 54 in an axial direction parallel to the pulling force 70 that exists on the cord 38. Also, the engagement between the retention element 54 and the distal end portion 50 creates a frictional resistance against rotation of the long support arm 46 that would prevent separation of the threadable engagement between the long support arm 46 and the electrical receptacle 25. Although, the neck portion 51 is shown, other configurations that accomplish both the the axial retention required and creating a frictional resistance against rotation of the long support arm 46 would be acceptable. These and other configurations could include, slots, grooves, an annulus, special high friction surface treatments or any other structure that would meet the aforementioned requirements. It is important to note an advantage of this electrical plug retainer system 20 and that the unused lower electrical receptacle 28 is free to use with any other plug and cord set assembly with the ability for another plug and cord set assembly to be retained or not retained to the lower electrical receptacle 28.

To effectively retain or lockably secure the plug 40 and cord 38 set assembly to the electrical wall outlet assembly 22 to the wall mounting 23, the electrical plug retainer system 20 must be able to withstand a pulling force 70 that would be on the cord 38. Also, to not allow the plug 40 to be removed from the upper electrical receptacle 26 while the cord 38 is secured through the retention element assembly 54 to the long support arm 46. The pulling force 70 is resisted by the retention element 54 being attached to the distal end portion 50 of the long support arm 46, this configuration is beneficial to protect the plug 40 and cord 38 interface point 79 from physical damage. If the interface point 79 were to experience the pulling force 70 there would be a risk of physical separation or damage at the interface point 79 by resulting in separation of the cord 38 and plug 40 potentially resulting and exposure of live wires or a short circuit. The risk of damage at interface point 79 is based upon two items, first the pullout resistance of the removable engagement between the plug 40 and the electrical receptacle 25 and the strength of the plug 40 and cord 38 interface. The retention element 54 as shown in FIG. 4 attempts to preclude this risk by securing the cord 38 to the long support arm 46 that is secured to the receptacle 25, thus removing the effect of the pulling force 70 from the interface 79. In addition, the distance between the retention element 54 location of engagement with the cord 38 and the plug and cord interface 79 must be kept at a minimal axial distance. The purpose of this is to prevent the ability of a child for instance to remove it the plug 40 from the upper receptacle 26 while the retention element 54 remains in a locked state as shown due to the flexibility of the short cord 38 section between the retention element 54 and interface 79.

Figure 5:
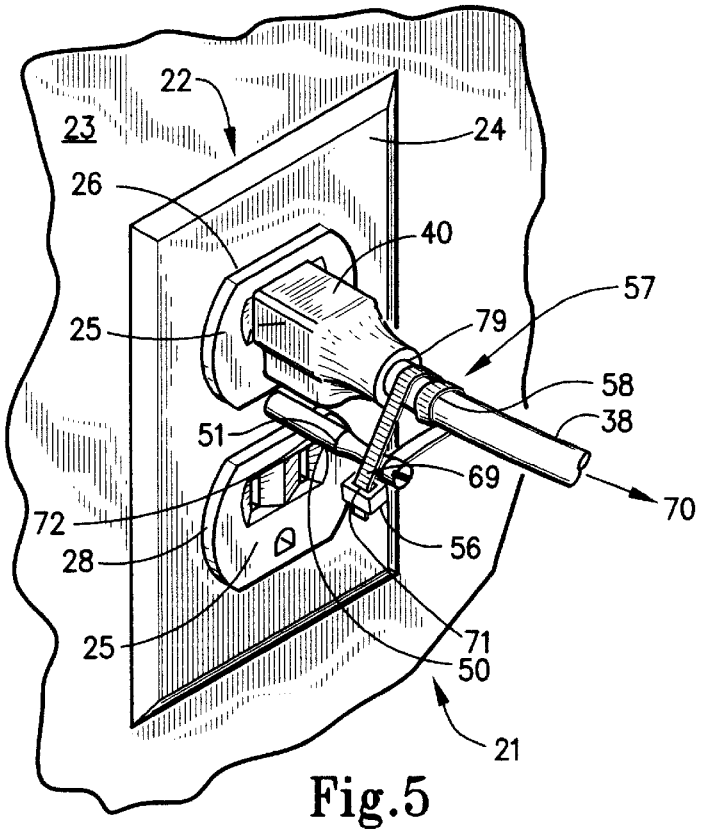
FIG. 5 shows an assembled perspective view of the electrical plug retainer assembly in use with a standard duplex electrical outlet utilizing the short support arm and cord wrapped retainer element.

Further, looking on to FIG. 5, an assembled perspective view is shown of the electrical plug retainer assembly 21 in use with a standard duplex electrical outlet utilizing the short support arm 72. The plug 40 is shown engaged to the upper electrical receptacle 26, wherein electrical power is able to be transmitted from the receptacle assembly 25 into the cord 38. The short support arm 72 is threadably engaged into the receptacle 25 and shown retaining the cover plate 24 in place. Retention element assembly 57 is shown in a locked state with the strap 58 showing the head 56 having the transverse aperture 71 lockably receiving a second end portion 69 of the strap 58. Thus, the retention element assembly 57 is engaging the distal end portion 50 of the short support arm 72 and is securing the plug 40 and cord 38 set assembly to the short support arm 72. Thus, the retention element assembly 57 being in a locked state resulting in the plug 40 and cord 38 assembly being lockably secured to the upper receptacle 25 which is a part of the electrical wall outlet assembly 22 mounted in the wall structure 23. The distal end portion 50 of the short support arm 72 shows the neck portion 51 engaging the strap 58 of the retention element assembly 57, this neck portion 51 helps to retain the retention element assembly 57 in an axial direction parallel to the pulling force 70 that exists on the cord 38. Also, the engagement between the retention element 57 and the distal end portion 50 creates a frictional resistance against rotation of the short support arm 72 that would prevent separation of the threadable engagement between the short support arm 72 and the electrical receptacle 25. Although, the neck portion 51 is shown, other configurations that accomplish both the the axial retention required and creating a frictional resistance against rotation of the short support arm 72 would be acceptable. These other configurations could include, slots, grooves, an annulus, special high friction surface treatments that are circumferential or not, or any other structure that would meet the aforementioned requirements. The engagement of the retention element assembly 57 to the cord 38 is configured to have the strap 58 length between the first end 65 and the second end portion 69 to be able to tightly engage or wrap around the periphery of the cord 38 to accomplish the same effect as described in FIG. 4 by retaining the cord 38 against pulling force 70, thus taking the pulling force 70 away from the plug and cord interface 79. As FIG. 5 shows, the engagement of the retention element assembly 57 and the cord 38 is configured such that the cord 38 need not be secured against the short support arm 72 as shown in FIG. 4, in order to secure the cord 38 against the pulling force 70 to prevent the transmission of pulling force 70 into the plug and cord interface 79. It is important to note an advantage of this electrical plug retainer system 21 is that the unused lower electrical receptacle 28 is free to use with any other plug and cord set assembly with the ability for the other plug and court set assembly to be retained or not retained to the lower electrical receptacle 28.

To effectively retain or lockably secure the plug 40 and cord 38 set assembly to the electrical wall outlet assembly 22 to the wall mounting 23, the electrical plug retainer system 21 must be able to withstand a pulling force 70 that would be on the cord 38. Also, to not allow the plug 40 to be removed from the upper electrical receptacle 26 while the cord 38 is secured through the retention element assembly 57 to the short extension arm 72. The pulling force 70 is resisted by the retention element 57 being attached to the distal end portion 50 of the short support arm 72, this configuration is beneficial to protect the plug 40 and cord 38 interface point 79 from physical damage. If the interface point 79 were to experience the pulling force 70 there would be a risk of physical separation or damage at the interface point 79 by resulting in separation of the cord 38 and plug 40 potentially resulting and exposure of live wires or a short circuit. The risk of damage at interface point 79 is based upon two criterion, first the pullout resistance of the removable engagement between the plug 40 and the electrical receptacle 25 and the strength of the plug 40 and cord 38 interface. The retention element 57 as shown in FIG. 5 attempts to preclude this risk by securing the cord 38 to the short support arm 72 by tightly engaging the periphery of the cord 38 with the retention element 57 being is secured to the short support arm 72 and thus to receptacle 25, removing the effect of the pulling force 70 from the interface 79.

Figure 6:
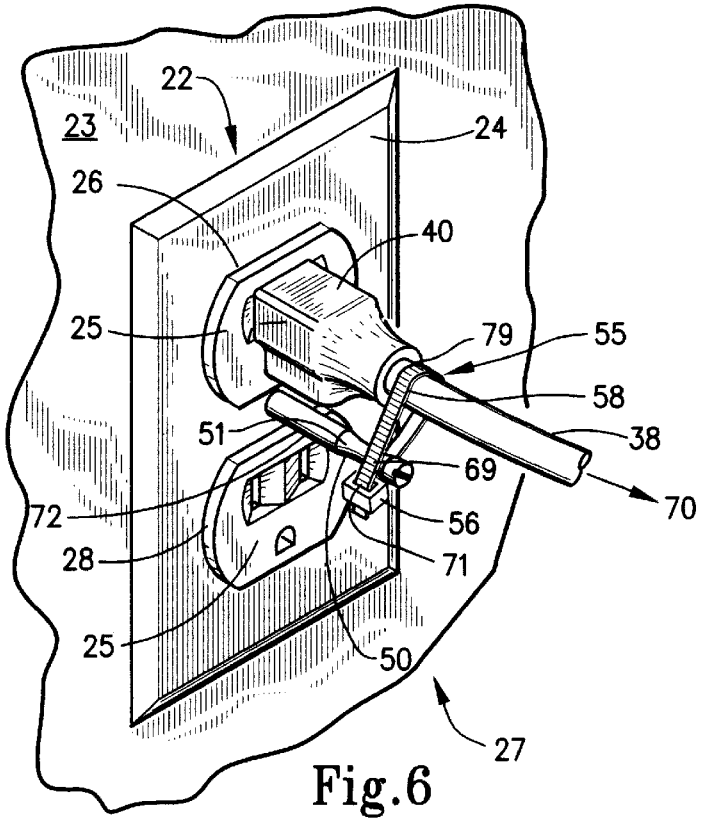
FIG. 6 shows an assembled perspective view of the electrical plug retainer assembly in use with a standard duplex electrical outlet utilizing the short support arm.

Next, turning to FIG. 6, an assembled perspective view is shown of the electrical plug retainer assembly 27 in use with a standard duplex electrical outlet utilizing the short support arm 72. The plug 40 is shown engaged to the upper electrical receptacle 26, wherein electrical power is able to be transmitted from the receptacle assembly 25 into the cord 38. The short support arm 72 is threadably engaged into the receptacle 25 and shown retaining the cover plate 24 in place. Retention element assembly 55 is shown in a locked state with the strap 58 showing the head 56 having the transverse aperture 71 lockably receiving a second end portion 69 of the strap 58. Thus, the retention element assembly 55 is engaging the distal end portion 50 of the short support arm 72 and is securing the plug 40 and cord 38 set assembly to the short support arm 72, with the retention element assembly 55 being in a locked state resulting in the plug 40 and cord 38 assembly and being lockably secured to the upper receptacle 26 which is a part of the electrical wall outlet assembly 22 mounted in the wall structure 23. The distal end portion 50 of the short support arm 72 shows the neck portion 51 engaging the strap 58 of the retention element assembly 55, this neck portion 51 helps to retain the retention element assembly 55 in an axial direction parallel to the pulling force 70 that exists on the cord 38. Also, the engagement between the retention element 55 and the distal end portion 50 creates a frictional resistance against rotation of the short support arm 72 that would prevent separation of the threadable engagement between the short support arm 72 and the electrical receptacle 25. Although, the neck portion 51 is shown, other configurations that accomplish both the the axial retention required and creating a frictional resistance against rotation of the short support arm 72 would be acceptable. These other configurations could include, slots, grooves, an annulus, special high friction surface treatments that are circumferential or not, or any other structure that would meet the aforementioned requirements. The engagement of the retention element assembly 55 to the cord 38 is configured to have the strap 58 be able to engage the cord 38 and axially rest against the plug and cord interface 79 to resist against pulling force 70, thus allowing the pulling force 70 operate against the plug and cord interface 79. This configuration of the retention element assembly 55 would be used in a situation where the risk of physical separation or damage of the plug 40 and cord 38 interface 79 from the pulling force 70 does not exist, and allows for a simple installation of the retention element assembly 55 to secure the plug 40 and cord 38 to the short support arm 72. As FIG. 6 shows, the engagement of the retention element assembly 55 and the cord 38 is configured such that the cord 38 need not be secured against the short support arm 72 as also shown in FIG. 5, in order to secure the plug 40 and cord 38 against the pulling force 70, thus securing the plug 40 and cord 38 to the electrical outlet assembly 22. It is important to note an advantage of this electrical plug retainer system 27 is that the unused lower electrical receptacle 28 is free to use with any other plug and cord set assembly with the ability for the other plug and court set assembly to be retained or not retained to the lower electrical receptacle 28.

Figure 7:
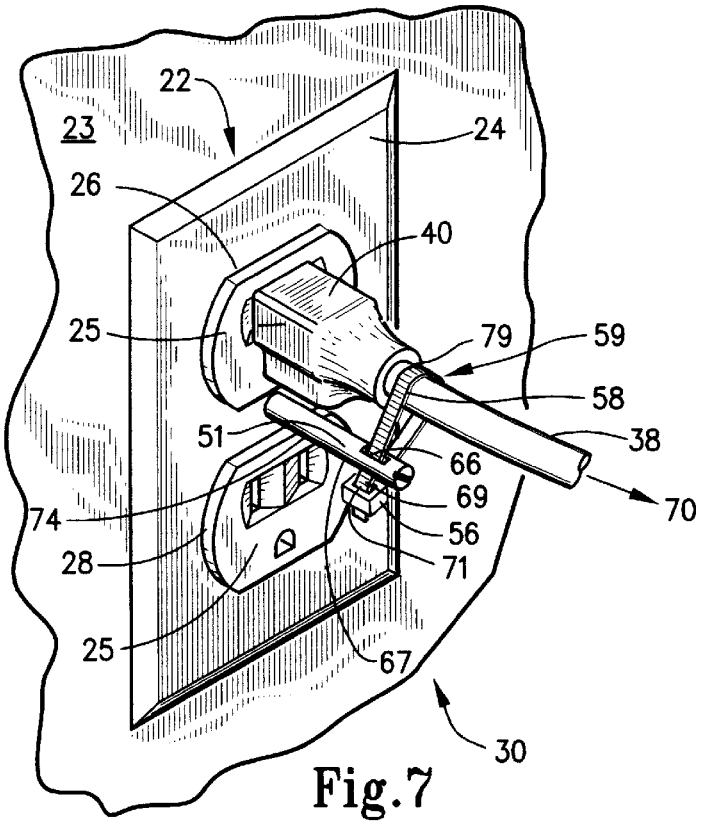
FIG. 7 shows an assembled perspective view of the electrical plug retainer assembly in use with a standard duplex electrical outlet utilizing the short slotted support arm.

Further looking on to FIG. 7, an assembled perspective view is shown of the electrical plug retainer assembly 30 in use with a standard duplex electrical outlet assembly 22 mounted in the wall structure 23, utilizing the short slotted support arm 74. The long slotted support arm 60 can be fully interchangeably used with the short slotted support arm 74 as described in FIG. 7. Using the long 60 or short 74 slotted support arm is determined by the plug 40 and cord 38 configuration and the space available around the electrical wall outlet assembly 22. The plug 40 is shown engaged to the upper electrical receptacle 26, wherein electrical power is able to be transmitted from the receptacle assembly 25 into the cord 38. The short slotted support arm 74 is threadably engaged into the receptacle 25 and shown retaining the cover plate 24 in place. Retention element assembly 59 is shown in a locked state with the strap 58 showing the head 56 having the transverse aperture 71 lockably receiving a second end portion 69 of the strap 58. Thus, the retention element assembly 59 is engaging the distal end portion 67 through the slot 66 of the short slotted support arm 74. This is securing the plug 40 and cord 38 set assembly to the short slotted support arm 74, with the retention element assembly 59 being in a locked state resulting in the plug 40 and cord 38 assembly and being lockably secured to the upper receptacle 26. Upper receptacle 26 is a part of the electrical wall outlet assembly 22 mounted in the wall structure 23. The distal end portion 67 of the short slotted support arm 74 shows the slot 66 receiving the strap 58 of the retention element assembly 59, this slot 66 helps to retain the retention element assembly 59 in an axial direction parallel to the pulling force 70 that exists on the cord 38. Also, the engagement between the retention element 59 and the slot 66 creates a positive lock against the rotation of the short slotted support arm 74 that would prevent separation of the threadable engagement between the short slotted support arm 74 and the electrical receptacle 25. The engagement of the retention element assembly 59 to the cord 38 is configured to have the strap 59 be able to engage the cord 38 and axially rest against the plug and cord interface 79 to resist against pulling force 70, thus allowing the pulling force 70 operate against the plug and cord interface 79. This configuration of the retention element assembly 59 would be used in a situation where the risk of physical separation or damage of the plug 40 and cord 38 interface 79 from the pulling force 70 does not exist, and allows for a simple installation of the retention element assembly 59 to secure the plug 40 and cord 38 to the short slotted support arm 74. As FIG. 7 shows, the engagement of the retention element assembly 59 and the cord 38 is configured such that the cord 38 need not be secured against the short slotted support arm 72 as also shown in FIG. 4, in order to secure the plug 40 and cord 38 against the pulling force 70, thus securing the plug 40 and cord 38 to the electrical outlet assembly 22. Optionally, the engagement of the retention element assembly 59 to the cord 38 can be configured to have the strap 58 be able to tightly engage the periphery of the cord 38 as shown in FIG. 5, to accomplish the same effect as described in FIG. 4 by retaining the cord 38 against pulling force 70, thus taking the pulling force 70 away from the plug and cord interface 79. It is important to note an advantage of this electrical plug retainer system 30 is that the unused lower electrical receptacle 28 is free to use with any other plug and cord set assembly with the ability for the other plug and court set assembly to be retained or not retained to the lower electrical receptacle 28.

Figure 8:
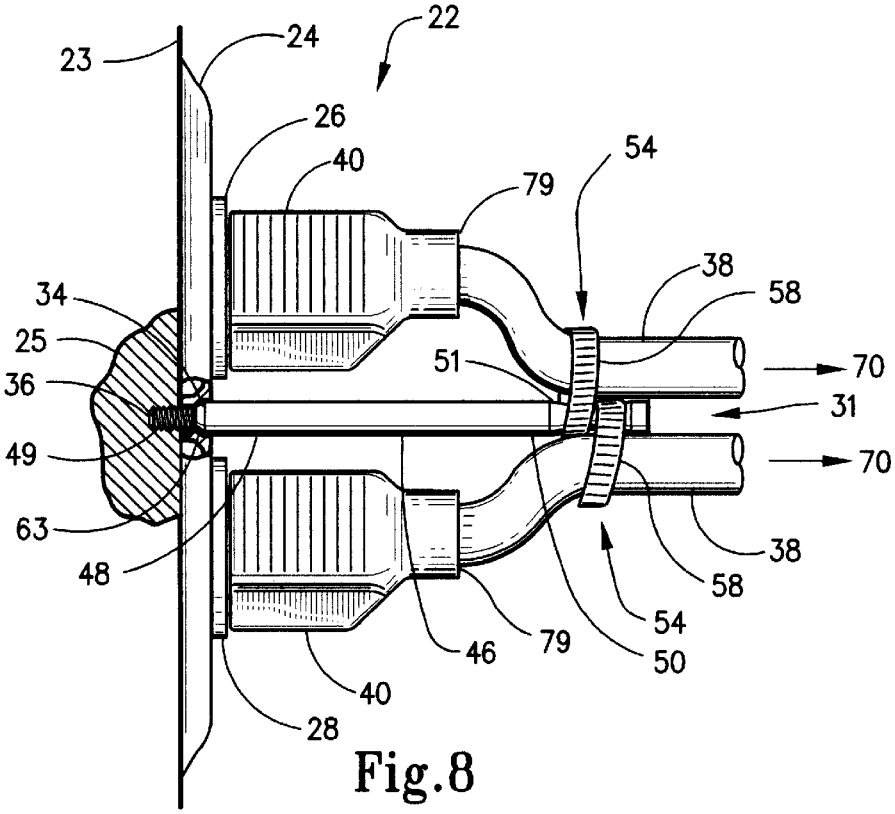
FIG. 8 shows a side view of the electrical plug retainer assembly in use securing two plugs to the standard duplex electrical outlet utilizing the long support arm.

Moving on to FIG. 8 shown is a side view of the electrical plug retainer assembly 31 in use securing two plugs 40 and cords 38 to the standard duplex electrical outlet assembly 22 that is mounted in the wall structure 23, utilizing the long support arm 46. One difference between the electrical plug retainer assembly 31 shown in FIG. 8 and the electrical plug retainer assembly 20 shown in FIG. 4, is that in FIG. 8 a plug 40 and cord 38 assembly is secured to the lower receptacle 28 in addition to a plug 40 and cord 38 assembly being secured to the upper electrical receptacle 26, utilizing a single long support arm 46. There is ample room on the distal end portion 50 of the long support arm 46 to engage two retention element assemblies 54, wherein each retention element assembly 54 engages a respective cord 38 of each one of the plugs 40. The retention element assemblies 54 are shown engaging the neck portion 51 of the long support arm 46. Although, the neck portion 51 is shown, other configurations that accomplish both the the axial retention required and creating a frictional resistance against rotation of the long support arm 72 would be acceptable. These other configurations could include, slots, grooves, an annulus, special high friction surface treatments that are circumferential or not, or any other structure that would meet the aforementioned requirements. The electrical plug retainer assembly 31 could also secure more than two or a plurality of plug 40 and cord 38 set assemblies to the electrical receptacle outlet assembly 22 if required, wherein each plug 40 would be removably engaged to a respective one electrical receptacle, for example the upper electrical receptacle 26, or the lower electrical receptacle 28, or any additional electrical receptacles. This would be accomplished by using a number of retention elements 54 that would be equal to the number of plug 40 and cord 38 said assemblies that needed to be secured to the electrical receptacle outlet assembly 22, using a single long support arm 46. Each retention element 54 would engage the distal end portion 50 of the long support arm 46 with the retention element 54 securing each plug 40 and cord 38 set to the long support arm 46 with the retention element 54 being in a locked state. Each plug 40 and cord 38 would be removable from the distal end portion 50 when the retention element 54 is in an unlocked state, typically by severing or cutting strap 58 or unlocking the aperture 71, in the head 56, see FIG. 1 for the aperture 71 and the head 56 detail.

An industry standard receptacle 25 and is shown that includes an upper receptacle 26 and a lower receptacle 28, this is termed in the industry as a duplex outlet or receptacle, with both the upper receptacle 26 and the lower receptacle 28 connected in parallel electrically providing an equal amount of available power for a mating plug 40. The electrical receptacle 25 typically mounts in a wall mounting structure 23 and utilizes a receptacle cover plate 24 to cover the exposed wiring that exists behind and to the side of the receptacle 25. There is normally provided a threaded opening 36 in the receptacle 25 that is adapted to receive a fastener that secures the cover plate 24 to the receptacle 25. In order to have a smooth appearing finish on the cover plate 24 there is typically a countersink 34 in the cover plate the allows the fastener to have a flush or nearly flush installed appearance with the cover plate 24. The aforementioned components form the electrical wall outlet assembly 22 which includes the receptacle 25, the cover plate 24 and the fastener (not shown). As can be seen from FIG. 8 the long support arm 46 acting through the proximal end portion 48 would replace the standard fastener that retains the cover plate 24 to the receptacle 25. The proximal end portion 48 configuration duplicates the configuration of the cover plate fastener insofar as the threads 49 and countersink portion mating surface 63 to enable the long support arm 46 to essentially replace the fastener in securing the cover plate 24 to the receptacle 25. This results in one of the major benefits of this support arm 46 configuration in that no modifications are required to either the cover plate 24 or the receptacle 25, which greatly simplifies installation of the long support arm 46 into an existing electrical wall outlet assembly 22.

To effectively retain or lockably secure the plug 40 and cord 38 set assemblies to the electrical wall outlet assembly 22 to the wall mounting 23, the electrical plug retainer system 31 must be able to withstand a pulling forces 70 that would be on the cords 38. Also, to not allow the plug 40 to be removed from the electrical receptacles 25 while the cords 38 are secured through the retention element assembly 54 to the long support arm 46. The pulling forces 70 are resisted by the retention elements 54 being attached to the distal end portion 50 of the long support arm 46, this configuration is beneficial to protect the plug 40 and cord 38 interface points 79 from physical damage. If the interface point 79 were to experience the pulling force 70 there would be a risk of physical separation or damage at the interface point 79 by resulting in separation of the cord 38 and plug 40 potentially resulting and exposure of live wires or a short circuit. The risk of damage at interface point 79 is based upon two items, first the pullout resistance of the removable engagement between the plug 40 and the electrical receptacle 25 and the strength of the plug 40 and cord 38 interface. The retention elements 54 as shown in FIG. 8 attempt to preclude this risk by securing the cord 38 to the long support arm 46 that is secured to the receptacle 25, thus removing the effect of the pulling force 70 from the interface 79. In addition, the distance between the retention elements 54 location of engagement with the cords 38 and the plug and cord interfaces 79 must be kept at a minimal axial distance. The purpose of this is to prevent the ability of a child for instance to remove it the plug 40 from the receptacles 25 while the retention elements 54 remain in a locked state as shown due to the flexibility of the short cords 38 section between the retention elements 54 and the interfaces 79.

Figure 9:
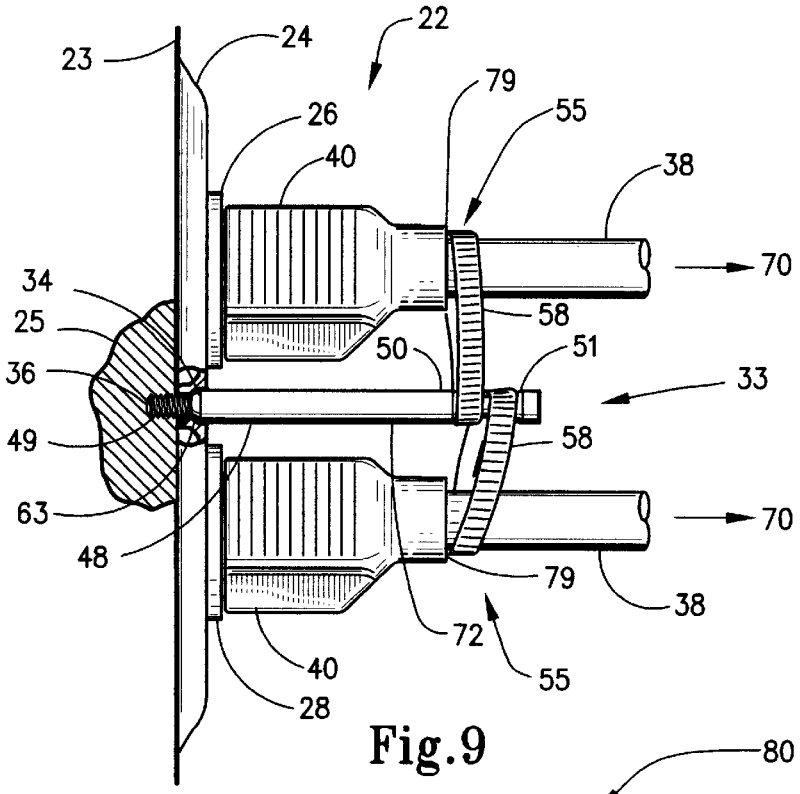
FIG. 9 shows a side view of the electrical plug retainer assembly in use securing two plugs to the standard duplex electrical outlet utilizing the short support arm.

Further on to FIG. 9 shown is a side view of the electrical plug retainer assembly 33 in use securing two plugs 40 and cords 38 to the standard duplex electrical outlet assembly 22 that is mounted in the wall structure 23, utilizing the short support arm 72. One difference between the electrical plug retainer assembly 33 shown in FIG. 9 and the electrical plug retainer assembly 27 shown in FIG. 6, is that in FIG. 9 a plug 40 and cord 38 assembly are secured to the lower receptacle 28 in addition to a plug 40 and cord 38 assembly being secured to the upper electrical receptacle 26, utilizing a single short support arm 72. There is ample room on the distal end portion 50 of the short support arm 72 to engage two retention element assemblies 55, wherein each retention element assembly 55 engages a respective cord 38 of each one of the plugs 40. The retention element assemblies 55 are shown engaging the neck portion 51 of the short support arm 72. Although, the neck portion 51 is shown, other configurations that accomplish both the the axial retention required and creating a frictional resistance against rotation of the short support arm 72 would be acceptable. These other configurations could include, slots, grooves, an annulus, special high friction surface treatments that are circumferential or not, or any other structure that would meet the aforementioned requirements. The electrical plug retainer assembly 33 could also secure more than two or a plurality of plug 40 and cord 38 set assemblies to the electrical receptacle outlet assembly 22 if required, wherein each plug 40 would be removably engaged to a respective one electrical receptacle, for example the upper electrical receptacle 26, or the lower electrical receptacle 28, or any additional electrical receptacles. This would be accomplished by using a number of retention elements 55 that would be equal to the number of plug 40 and cord 38 said assemblies that needed to be secured to the electrical receptacle outlet assembly 22, using a single short support arm 72. Each retention element 55 would engage the distal end portion 50 of the short support arm 72 with the retention element 55 securing each plug 40 and cord 38 set to the short support arm 72 with the retention element 55 being in a locked state. Each plug 40 and cord 38 would be removable from the distal end portion 50 when the retention element 55 is in an unlocked state, typically by severing or cutting strap 58 or unlocking the aperture 71 in the head 56, see FIG. 1 for the aperture 71 and the head 56 detail.

An industry standard receptacle 25 and is shown that includes an upper receptacle 26 and a lower receptacle 28, this is termed in the industry as a duplex outlet or receptacle, with both the upper receptacle 26 and the lower receptacle 28 connected in parallel electrically providing an equal amount of available power for a mating plug 40. The electrical receptacle 25 typically mounts in a wall mounting structure 23 and utilizes a receptacle cover plate 24 to cover the exposed wiring that exists when behind and to the side of the receptacle 25. There is normally provided a threaded opening 36 in the receptacle 25 that is adapted to receive a fastener that secures the cover plate 24 to the receptacle 25. In order to have a smooth appearing finish on the cover plate 24 there is typically a countersink 34 in the cover plate that allows the fastener to have a flush or nearly flush installed appearance with the cover plate 24. The aforementioned components form the electrical wall outlet assembly 22 which includes the receptacle 25, the cover plate 24 and the fastener. As can be seen from FIG. 9 the short support arm 72 acting through the proximal end portion 48 would replace the standard fastener that retains the cover plate 24 to the receptacle 25. The proximal end portion 48 configuration duplicates the configuration of the cover plate fastener insofar as the threads 49 and countersink portion mating surface 63 to enable the short support arm 72 to essentially replace the fastener in securing the cover plate 24 to the receptacle 25. This results in one of the major benefits of this support arm 72 configuration in that no modifications are required to either the cover plate 24 or the receptacle 25, which greatly simplifies installation of the short support arm 72 into an existing electrical wall outlet assembly 22.

The engagement of the retention element assembly 55 to the cords 38 is configured to have the straps 58 be able to engage the cords 38 and axially rest against the plug and cord interfaces 79 to resist against pulling forces 70, thus allowing the pulling forces 70 operate against the plug and cord interfaces 79. This configuration of the retention element assemblies 55 would be used in a situation where the risk of physical separation or damage of the plug 40 and cord 38 interface 79 from the pulling forces 70 does not exist, and allows for a simple installation of the retention element assemblies 55 to secure the plugs 40 and cords 38 to the short support arm 72. As FIG. 9 shows, the engagement of the retention element assemblies 55 and the cords 38 are configured such that the cords 38 need not be secured against the short extension arm 72 as is shown in FIG. 8, in order to secure the plugs 40 and cords 38 against the pulling forces 70, thus securing the plugs 40 and cords 38 to the electrical outlet assembly 22.

Figure 10:
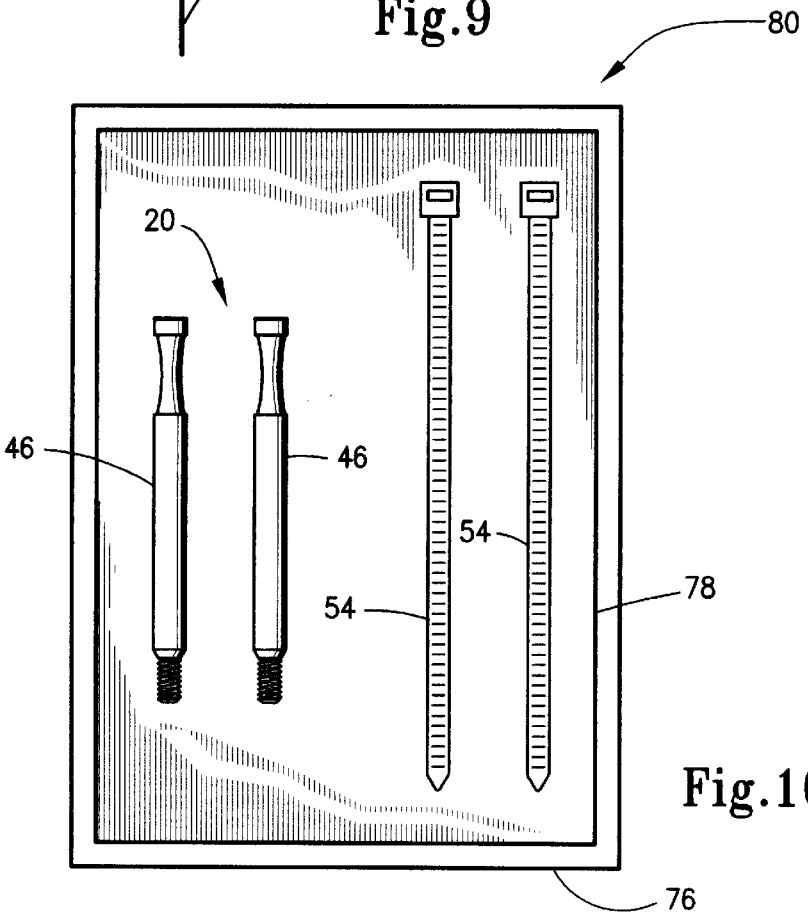
FIG. 10 shows a kit assembly drawing for the electrical plug retainer assembly.

Finally turning to FIG. 10 a kit assembly 80 drawing for the electrical plug retainer assembly is shown for the electrical plug retainer system assembly 20. The kit assembly 80 includes the support arm 46, the retention element 54, and the kit package 76. As an option, an instructional sheet or card 78 can be included in the kit package for the purpose of providing instructions in the use of the electrical plug retainer assembly 20. The kit assembly 80 can include a number of different combinations of support arms and retention elements and is not limited by what is depicted in FIG. 10. For instance, support arms include the long support arm 46, the short support arm 72, short slotted support arm 74, or the long slotted support arm 60. Any combination of the aforementioned support arms in any quantity could potentially be provided in the kit assembly 80. Retention element assembly 54, retention element assembly 57, retention element assembly 55, or retention element assembly 59 could be provided in any combination or quantity also. However, the basic kit assembly 80 would contain one support arm and one retention element, with the option of either a plurality of support arms or retention elements provided. The package 76 can be a plastic bubble pack, a transparent bag, a box, or any suitable equivalent that can contain the aforementioned components.

METHOD OF USE

Referencing FIG. 1 as a starting point for the method of using the electrical plug retainer system 20 that is adapted to lockably secure the plug 40 and cord 38 set assembly that is removably engaged to the electrical receptacle 25 that typically has two electrical receptacle outlets, one being an upper electrical receptacle 26 and one being a lower electrical receptacle 28. The purpose of the electrical plug retainer system is to protect against accidental removal of the plug 40 and cord 38 set assembly from the electrical receptacle 25, that would result in the undesirable lost of electrical power to the device that the cord 38 is electrically connected to. Although the method of use for the electrical plug retainer system 20 is done using FIG. 1 this does not limit the method of use to the specific elements identified in FIG. 1 as a number of different embodiments are identified in the remaining Figures with the following method of use equally applicable to the various different embodiments that have been previously identified. The first step would be to provide a support arm 46 that includes a proximal end portion 48 and a distal end portion 50. Following this, the next step would be to mount the proximal end portion 48 of the support arm 46 adjacent to the electrical receptacle 25 in a manner such that the support arm 46 extends from the electrical receptacle 25 and is also supported by the electrical receptacle 25. As shown in FIG. 1 this mounting step would be accomplished by threadably engaging the proximal end portion 48 of the support arm 46, which would include a threaded portion 49 and a mating countersink surface 63 into the electrical receptacle 25 that contains the cover plate 24 fastener attachment. This fastener attachment in the electrical receptacle 25 includes a threaded portion 36 and a countersink mating surface 34 that will threadably engage with the respective threaded portion 49 and countersink surface 63 of the support arm 46. At this step, other methods of mounting the support arm 46 adjacent to the receptacle 25 would be acceptable as long as the support arm 46 extended from and was supported by the receptacle 25. These alternative mounting methods could include snaps, interlocking slots, retainer heads, adhesives, and the like.

Following this, a subsequent step would be to engage the plug 40 and cord 38 set assembly into the electrical receptacle 26 as shown in FIG. 4 in a conventional manner. The next step would be to provide the retention element 54, with the following step to secure the retention element 54 to engage the distal end portion 50 of the support arm 46. Initially, to secure the retention element 54, pre position retention element 54 as shown in FIG. 1 with the retention element circumferentially enveloping the cord 38 and the distal end portion 50 of the support arm 46. To complete the securing step the second end portion of the strap 69 should be inserted into the transverse aperture 71 of the head 56 that forms a portion of the retention element 54. Continue pushing the second end portion of the strap 69 through the transverse aperture 71 of the head 56 until the second end portion of the strap 69 protrudes from the opposite end of the aperture 71 with a length sufficient for a finger hold, at this time pull on the second end portion of the strap 69 until the strap 58 cinches up tight and subsequently lockably secures the cord 38 to the distal portion 50 of the support arm 46. The excess strap 58 that is unused extending freely in a cantilevered matter from the aperture 71 can be trimmed off. At this point the plug 40 and cord 38 should be lockably secured to the support arm 46 which results in the plug 40 being lockably secured to the electrical receptacle 26. Optionally, a plurality of retention elements 54 could be provided that would accommodate the ability to lockably secure a plurality of plug 40 and cord 38 set assemblies as shown in FIGS. 8 and 9 utilizing a single support arm 46. Each retention element 54 would be used to lockably secure a respective one of the plug 40 and cord 38 set assemblies to a single distal end portion 50 of the support arm 46, with each one of the plug 40 and cord 38 set assemblies that are each removably engaged with a respective one of a plurality of electrical receptacles, such as upper receptacle 26 and lower receptacle 28.

CONCLUSION

Accordingly, the present invention of an electrical plug retainer assembly has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

What is claimed is:

1. An electrical plug retainer system adapted to lockably secure a plug and cord set assembly that is removably engaged to an electrical receptacle, to protect against accidental removal of the plug and cord set assembly from the receptacle, comprising:

(a) a support arm extending from and supported by the receptacle, said support arm includes a proximal end portion adjacent to the receptacle and a distal end portion opposite said proximal end portion; and (b) a retention element comprising a flexible and an enlarged head on a first end of said strap, said head having a transverse aperture, said retention element adapted to lockably engage said distal end portion of said support arm, said retention element also adapted to lockably engage the cord of the plug and cord set assembly, wherein said retention element lockably secures the plug and cord set assembly to said support arm resulting in the plug and cord set assembly being lockably secured to the receptacle when said retention element is in a locked state, the plug and cord set assembly is removable from said support arm and the receptacle when said retention element is in an unlocked state.

2. An electrical plug retainer system according to claim 1 wherein said support arm is affixed to the receptacle.

3. An electrical plug retainer system according to claim 1 wherein said support arm is detachable from the receptacle.

4. An electrical plug retainer system according to claim 1 further including a plurality of plug and cord set assemblies that are each removably engaged with a respective one of a plurality of electrical receptacles, and a plurality of retention elements, each one of said retention elements engaging said distal end portion of said support arm and secures each one of the plug and cord set assemblies to said support arm when in a locked state, each one of said retention elements is removable from said distal end portion when in an unlocked state, wherein each plug and cord set assembly is lockably secured to the respective receptacle when each said retention element is in a locked state.

5. An electrical plug retainer system according to claim 1 wherein said retention element has a strap length between said first end and said second end portion to tightly engage a periphery of the cord.

6. An electrical plug retainer system according to claim 1 wherein said distal end portion has a necked section to engage said retention element.

7. An electrical plug retainer system according to claim 1 wherein said support arm is constructed of a non electrically conductive material.

8. An electrical plug retainer system according to claim 1 wherein said retention element is constructed of a non electrically conductive material.

9. An electrical plug retainer system according to claim 1 wherein said support arm and said retention element are configured to minimize physical damage to the plug and cord.

10. An electrical plug retainer system according to claim 1 wherein said support arm is threadably engaged with the receptacle.

11. An electrical plug retainer system according to claim 10 wherein said distal end portion and said retention element engagement is operative to prevent said threadable engagement from separating.

12. An electrical plug retainer system adapted to lockably secure a plug and cord set assembly that is removably engaged to an electrical receptacle, the receptacle being mounted in a wall structure having a wall surface, with the receptacle parallel to the wall surface and a receptacle cover plate that is adjacent to the wall surface, said plug retainer system protecting against accidental removal of the plug and cord set assembly from the receptacle, comprising:

(a) a support arm extending perpendicularly from and supported by the receptacle, said support arm includes a proximal end portion adapted to attach to the receptacle and a distal end portion opposite said proximal end portion; and (b) a retention element comprising a flexible and an enlarged head on a first end of said strap, said head having a transverse aperture, said retention element adapted to lockably engage said distal end portion of said support arm, said retention element also adapted to lockably engage the cord of the plug and cord set assembly, wherein said retention element lockably secures the plug and cord set assembly to said support arm resulting in the plug and cord set assembly being lockably secured to the receptacle when said retention element is in a locked state, the plug and cord set assembly is removable from said support arm and the receptacle when said retention element is in an unlocked state.

13. An electrical plug retainer system according to claim 12 wherein said distal end portion has a circumferential groove and neck forming an annulus to engage said retention element.

14. An electrical plug retainer system according to claim 12 further including a plurality of plug and cord set assemblies that are each removably engaged with a respective one of a plurality of electrical receptacles, and a plurality of retention elements, each one of said retention elements engaging said distal end portion of said support arm and secures each one of the plug and cord set assemblies to said support arm when in a locked state, each one of said retention elements is removable from said distal end portion when in an unlocked state, wherein each plug and cord set assembly is lockably secured to the respective receptacle when each said retention element is in a locked state.

15. An electrical plug retainer system according to claim 12 wherein said retention element has a strap length between said first end and said second end portion to tightly engage a periphery of the cord.

16. An electrical plug retainer system according to claim 12 wherein said support arm is constructed of a non electrically conductive material.

17. An electrical plug retainer system according to claim 12 wherein said retention element is constructed of a non electrically conductive material.

18. An electrical plug retainer system according to claim 12 wherein said support arm and said retention element are configured to minimize physical damage to the plug and cord.

19. An electrical plug retainer system according to claim 12 wherein said support arm is threadably engaged with the receptacle.

20. An electrical plug retainer system according to claim 19 wherein said distal end portion and said retention element engagement is operative to prevent said threadable engagement from separating.

21. An electrical plug retainer system according to claim 20 wherein said threadable engagement is adapted to retain the cover plate in position adjacent to the receptacle and wall.

22. An electrical plug retainer system according to claim 19 wherein said distal end portion has a means for tightening said threadable engagement.

23. An electrical plug retainer system according to claim 22 wherein said means for tightening is tamper proof wherein said threadable engagement cannot be directly disengaged.

24. A kit for the use of an electrical plug retainer system adapted to lockably secure a plug and cord set assembly that is removably engaged to an electrical receptacle to protect against accidental removal of the plug and cord set assembly from the receptacle, comprising:

(a) a support arm extending from and supported by the receptacle, said support arm includes a proximal end portion adjacent to the receptacle and a distal end portion opposite said proximal end portion;

(b) a retention element comprising a flexible and an enlarged head on a first end of said strap, said head having a transverse aperture, said retention element adapted to lockably engage said distal end portion of said support arm, said retention element also adapted to lockably engage the cord of the plug and cord set assembly, wherein said retention element lockably secures the plug and cord set assembly to said support arm resulting in the plug and cord set assembly being lockably secured to the receptacle when said retention element is in a locked state, the plug and cord set assembly is removable from said support arm and the receptacle when said retention element is in an unlocked state; and (c) a package for receiving said support arm and said retention element.

25. A kit for the use of an electrical plug retainer system according to claim 24 further including a set of instructions related to the use of said electrical plug retainer system adapted to lockably secure a plug and cord set assembly that is removably engaged to an electrical receptacle to protect against accidental removal of the plug and cord set assembly from the receptacle.

26. A kit for the use of an electrical plug retainer system according to claim 24 further including a plurality of retention elements.

27. A kit for the use of an electrical plug retainer system according to claim 26 further including a plurality of support arms.

28. A method of using of an electrical plug retainer system adapted to lockably secure a plug and cord set assembly that is removably engaged to an electrical receptacle to protect against accidental removal of the plug and cord set assembly from the receptacle, comprising the steps of:

(a) providing a support arm that includes a proximal end portion and a distal end portion opposite said proximal end portion;

(b) mounting said proximal end portion of said support arm adjacent to the receptacle such that said support arm extends from and is supported by the receptacle;

(c) engaging the plug and cord set to the electrical receptacle;

(d) providing a retention element comprising a flexible and an enlarged head on a first end of said strap, said head having a transverse aperture, said retention element; and (e) securing said retention element to lockably engage said distal end portion of said support arm and to lockably engage said retention element to the cord of the plug and cord set assembly such that the plug and cord set assembly is lockably secured to said support arm, wherein the plug and cord set assembly is lockably secured to the electrical receptacle.

29. A method of using of an electrical plug retainer system according to claim 28 further including the step of providing a plurality of retention elements to lockably secure a plurality of plug and cord set assemblies that are each removably engaged with a respective one of a plurality of electrical receptacles.

* * * * *